United States Patent [19]

Borchard et al.

[11] 3,985,521

[45] Oct. 12, 1976

[54] METHOD FOR PRODUCING A GRINDING FOIL

[75] Inventors: Heinz Borchard, Nortorf; Robert Kasch, Alt Muhlendorf; Bruno Rybka, Nortorf; Herbert Knothe, Neumunster, all of Germany

[73] Assignees: TED Bildplatten Aktiengesellschaft; AEG-Telefunken-Teldec, both of Zug, Switzerland

[22] Filed: Mar. 26, 1974

[21] Appl. No.: 454,800

[52] U.S. Cl. ..... 51/295; 51/293

[51] Int. Cl.[2] ..... B24D 11/02

[58] Field of Search ..... 51/295, 293, 298, 309

[56] References Cited

UNITED STATES PATENTS

| | | | |
|---|---|---|---|
| 2,220,140 | 11/1940 | Bartling et al. | 51/298.1 |
| 2,705,194 | 3/1955 | St. Clair | 51/293 |
| 2,899,288 | 8/1959 | Barclay | 51/295 |
| 3,042,508 | 7/1962 | Haigis et al. | 51/295 |
| 3,377,264 | 4/1968 | Duke et al. | 51/295 |
| 3,517,464 | 6/1970 | Mattia et al. | 51/295 |
| 3,622,288 | 11/1971 | Rue | 51/295 |

*Primary Examiner*—Donald J. Arnold
*Attorney, Agent, or Firm*—Spencer & Kaye

[57] ABSTRACT

A grinding foil which is to be used for grinding a record cutting or playback stylus is manufactured by providing a surface layer of a plastic foil with indentations for accommodating a grinding agent in granular form, filling the indentations with such grinding agent, and thermoplastically deforming the surface layer to smooth the foil surface and to bond the grinding agent into the surface layer.

6 Claims, 6 Drawing Figures

FIG.1
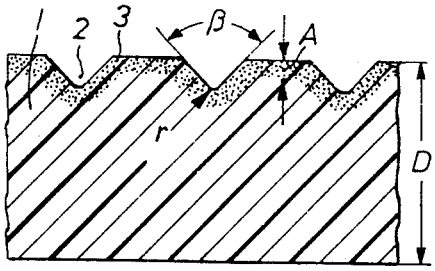
FIG.2
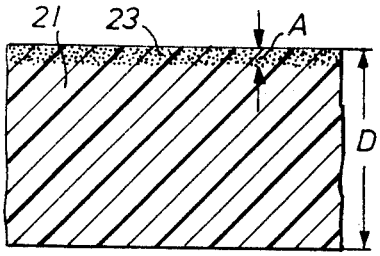
FIG.3
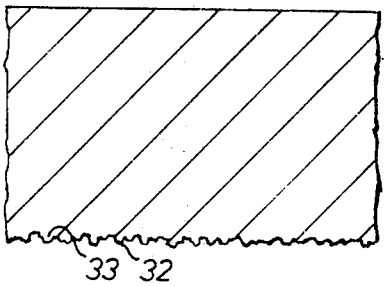
FIG.4
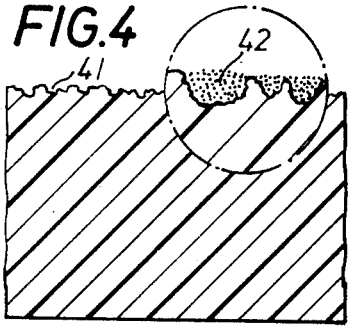
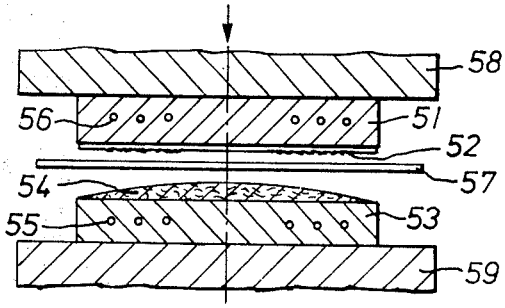
FIG.5
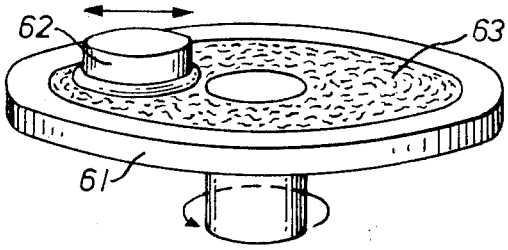
FIG.6

METHOD FOR PRODUCING A GRINDING FOIL

BACKGROUND OF THE INVENTION

The present invention relates to a method for producing a grinding foil made of plastic and having a grinding agent uniformly distributed and pressed in to enrich the surface of the foil, the grinding agent being a diamond powder, in particular, and the foil being provided for grinding cutting styli and pickups used for playback of information carriers in the form of record discs.

Grinding foils as well as methods for grinding to restore the original profile of a mechanical signal pickup and apparatus for performing the grinding method are already known and are disclosed, for example, in German Offenlegungsschrift (Laid-Open Application) No. 2,053,866.

In order to practice this profile grinding method, a flexible plastic foil is required which should have a thickness, for example, of approximately $100\mu$, its surface containing grooves whose cross section corresponds to the desired shape of the pickup to be ground. This surface is provided with a finely distributed grinding agent, for example a diamond powder, which is embedded in its surface.

For the unprofiled grinding of cutting styli which are to be used for cutting modulated signal grooves into lacquer foils forming the preliminary versions, or originals, of picture or phonograph records, flexible plastic grinding discs are required that must have planar, unprofiled surfaces. These surfaces are also provided with an embedded grinding agent.

As has been found in practice, grinding foils suitable for the intended purpose must meet stringent requirements, particularly with respect to the adhesion and penetration depth of the grinding agent embedded in the surface of the grinding foil.

SUMMARY OF THE INVENTION

It is therefore an object of the present invention to produce an improved grinding foil having a surface layer of a grinding agent, which layer has a well-defined thickness, the grinding agent being uniformly distributed and embedded in the surface with a sufficiently high concentration and with satisfactory adhesion.

This is accomplished, according to the present invention, by providing the surface of the plastic foil uniformly with indentations for accommodating the grinding agent, filling the indentations with the grinding agent, and then thermoplastically deforming the foil in a stamping process so that a plane surface is produced and the grinding agent is bonded into the surface layer.

In one embodiment of the present invention, the surface of the plastic foil is provided with indentations in a stamping process, these indentations are filled with the grinding agent and in a further stamping process the surface is smoothened and the grinding agent is bonded in.

In order to produce the above-mentioned indentations it is advantageous to use a stamping matrix whose surface relief has been produced by cavitation of a metal surface. The cavitation, i.e. the formation of cavities or indentations, in the surface, produces a roughened sponge-like surface with which the desired indentations on the surface of the plastic foil can be produced.

In a further embodiment of the present invention the surface roughness which is used to produce, by electrolytic deposition procedures, a stamping matrix with the corresponding surface roughness is created on a metal surface by an etching process. This permits the production of indentations which are uniformly distributed over the entire area. Moreover, an etching process provides good control over the desired depth of the roughened area.

Depending on the requirements to be met, the indentations in the surface of metal from which matrixes can be made, which will produce the corresponding indentations, or the indentations on the foil surface itself, can also be made in ways other than by etching, for example, by cavitation of the surface in an ultrasonic bath or by treating the surface with electrical arc or spark discharges.

BRIEF DESCRIPTION OF THE DRAWING

FIG. 1 is a cross-sectional detail view of a grinding foil for grinding pickup styli.

FIG. 2 is a cross-sectional view of a grinding foil without grooves, used for the grinding of cutting styli.

FIG. 3 is a cross-sectional view of a matrix for roughening a foil in a stamping process.

FIG. 4 is a cross-sectional view of a roughened foil produced by a stamping process utilizing a matrix according to FIG. 3. The sectional view shown enlarged in a circle shows the indentations in the surface filled with the grinding agent.

FIG. 5 is a side pictorial view of a stamping device for producing indentations on a plastic surface.

FIG. 6 is a perspective view of an apparatus for rubbing grinding agent into the indentations of a foil.

DESCRIPTION OF THE PREFERRED EMBODIMENTS

The grinding foil shown in FIG. 1 consists of a plastic foil 1 having a thickness D of approximately $100\mu$ and provided with grooves 2 defining a profile for grinding pickups, the profile enclosing an angle $\beta$ of approximately 90° and having a radius $r$ of approximately $1\mu$ at its bottom. The grinding agent is bonded to a surface layer 3 having a thickness A of about $10\mu$.

The grinding foil shown in FIG. 2 is also composed of a plastic foil 21 having a thickness D of $100\mu$. The surface of this foil bears no grooves. The surface layer 23 which is enriched with grinding agent has a $1\mu$ thickness dimension A.

The grinding foil is produced in three steps. In the first step the indentations on the surface of the plastic foil are produced, particularly by a stamping process, and serve to accommodate the grinding agent.

In the second step the grinding agent is distributed into the indentations in the surface, preferably by a rubbing process, and in the third step the final surface configuration is produced by stamping in that, by thermoplastic deformation, the uppermost layer of the plastic is melted, the grinding agent is bonded to the upper layer of the plastic and the upper layer is given a smooth surface.

One embodiment of the present invention for producing a grinding foil will be described below.

The indentations in the plastic surface are produced, for example, in a stamping device as shown schematically in FIG. 5.

The stamping mold includes a heatable and coolable part 51 having channels 56 and a matrix 52 disposed at its frontal face.

For the area of the grinding foil which will later be covered with the grinding agent, the matrix has a surface relief whose configuration, with respect to the nature and depth of the desired roughness, is adapted to the grinding agent in question. Opposite the mold half 51 bearing the matrix there is a second mold half 53 with a pad 54 disposed at its frontal face. Since high demands are made on the planar movement of the grinding foil 57 and its surface, it is recommended to employ a curved stamping pad 54.

Since the characteristics of the surface relief are a significant prerequisite for the production of a grinding foil, they will be discussed first.

It is important to have the relief 33 of the matrix (FIG. 3), which will be used for roughening the foil surface before the embedding of the grinding agent, adapted to the grain size of the grinding agent. Thus, for example, if diamond bort 42 (FIG. 4) is to be used which has a grain size of 0–0.5$\mu$, the raised portions 32 for producing the caverns or indentations 41 (FIG. 4) in the foil surface should have an average depth of about 4$\mu$.

It has been found to be correct in principle for the depth of the roughness in the foil surface, as prepared for the embedding of grinding agent, to be about 8 times the maximum grain size. While this substantially determines the later thickness of the grinding layer, i.e. dimension A in FIG. 2, the configuration of the surface relief is decisive for the attainment of a high degree of fill and good adhesion of the grinding agent. Cavern-type indentations with rough, almost vertical walls, as shown in the enlarged part of FIG. 4, within the circle, are desirable. The individual caverns must be directly adjacent one another and must be randomly distributed over the entire area. In this way, uniform embedding of the grinding agent during the subsequent second step — the rubbing on of the grinding agent — and good bonding of the grinding agent with the foil during the third step — the stamping of the surface under the influence of heat — are achieved.

The matrix required for roughening the foil surface must contain a negative version of the relief of the foil surface. The raised portions 32 of the matrix relief then correspond to, and form, the cavern-type indentations 41 (FIG. 4) in the foil surface.

It has been found that such a surface relief can be produced particularly well by an etching process. The etched "original" can be produced, for example, by etching a copper plate with nitric acid.

The thus produced surface relief then corresponds to the surface of the foil as it is to be stamped. The intermediate steps for producing the stamping matrix 33, the production of a "master" and a "mother" — correspond to those used in the conventional phonograph record production involving electroplating.

According to these intermediate steps, the master is produced from the etched copper original as an electroplated negative. The etched caverns appear on the master as raised portions. A further step is the production of a galvano-plastic reproduction of the master producing a positive known as the mother. Finally a third object, the matrix 52, is galvanically reproduced from the mother.

The foil material 57 (FIG. 5) is then brought between the mold halves 51 and 53 for stamping. After closing of the press halves 58 and 59 under high pressure, heat reaches the mold half 51 through channels 56 and is transferred to the foil 57 via matrix 52. The surface of the foil 57 is melted by the heat and is plastically deformed under the applied pressure so that it takes on the surface relief of the matrix 52. The heat is then removed by the introduction of a coolant into channels 55 and 56 and finally, after opening of the press, the finished, cooled foil can be removed from the mold.

In the second step the grinding agent is rubbed, either manually or by means of a wiper provided for this purpose, as shown in FIG. 6, into the surface caverns of the foil disc 63 disposed on plate 61. It is here important that the grinding agent be rubbed into the caverns in all directions by oscillating movements of the wiper 62 during rotation of the plate 61. The direction of rotation of plate 61 should be reversed from time to time. With this forward and backward rotation and the lateral wiping movements it becomes possible to achieve uniform distribution of the grinding agent and to rub it into all of the indentations. It is advantageous to mechanize the wiper device. The excess grinding powder is simply brushed from the surface when the rubbing process is completed.

Upon completion of the rubbing process the surface caverns, as shown to an enlarged scale in the circle in FIG. 4, should be filled with grains 42 of the grinding agent.

In the third and last step an apparatus as shown in FIG. 5 is used, however with a matrix having a smooth surface, and the surface shown in FIG. 4 which has been enriched with grinding powder is melted and the grinding powder is dispersed and bonded by the resulting flow process. This produces a substantially random distribution of the grinding agent to a rather precise penetration depth. It is important, however, that by accurate metering of the quantity of heat, in terms of temperature and time, and by maintaining a precise stamping pressure, the grinding agent be bonded directly at the surface. The quantity of heat and the pressure to be maintained are dependent upon the deformation properties of the foil material employed. It has been found, for example, that when the foil is of E-PVC having a K value of 78, a heating period of 8 seconds at a temperature of 170° C and a pressure of 170 kp/cm$^2$ (kp = kiloponds = kilograms force) are required.

In special cases, when a high grinding agent density is desired — as, for example, for foils for grinding the cutting surfaces on styli for cutting information grooves — it is recommended to use the roughened matrix of the first stamping process for the third step in order to produce new caverns or indentations for a second coating with grinding agent.

These process steps can be repeated at will until the desired enrichment has been attained before the last step, which involves pressing with the smooth, unroughened matrix.

In the third and last step the final surface of the grinding foil is simultaneously produced. This means that, depending on the intended purpose, the profile grooves can be stamped in or a smooth surface can be formed.

It will be understood that the above description of the present invention is susceptible to various modifications, changes and adaptations, and the same are intended to be comprehended within the meaning and range of equivalents of the appended claims.

We claim:

1. Method for producing a plastic grinding foil having a hard grinding agent constituted by diamond powder uniformly distributed in a layer at the surface of the foil for grinding cutting styli or pickups for information carriers, the foil being flexible and being constituted at least in the layer at such surface by a thermoplastically deformable material, comprising: providing the surface of the plastic foil with indentations whose depth is at least several times the maximum grain size of the grinding agent for accommodating the grinding agent by stamping the surface with a metal stamping matrix whose surface presents projections corresponding to such indentations; then filling the indentations with such grinding agent; and subsequently thermoplastically deforming such surface layer by subjecting the layer to a stamping operation by a matrix having a smooth surface for smoothing the surface and bonding the grinding agent into the surface layer.

2. A method as defined in claim 1 comprising the preliminary step of producing the stamping matrix by cavitation of the surface of a matrix blank.

3. A method as defined in claim 1 comprising the preliminary steps of providing the surface of a member with indentations corresponding to those to be provided in the surface of the plastic foil, and forming the stamping matrix by electrolytic deposition of a metal layer on such surface of the member.

4. A method as defined in claim 1 wherein said step of filling is carried out by depositing the grinding agent on the foil surface, causing a wiper element to bear against the foil surface, and effecting a relative rotating and oscillating movement between the element and the foil to rub the grinding agent into the indentations.

5. A method as defined in claim 1 further comprising performing said steps of providing and filling alternately a plurality of times prior to said step of thermoplastically deforming.

6. A method as defined in claim 1, wherein said step of providing indentations includes giving such indentations depths of the order of $10\mu$ in magnitude.

* * * * *

UNITED STATES PATENT AND TRADEMARK OFFICE

CERTIFICATE OF CORRECTION

PATENT NO. : 3,985,521

DATED : October 12th, 1976

INVENTOR(S) : Heinz Borchard et al

It is certified that error appears in the above-identified patent and that said Letters Patent are hereby corrected as shown below:

In the heading of the patent, change item [73] to read:
--[73] Assignee: TED Bildplatten Aktiengesellschaft
AEG-Telefunken-Teldec, of Zug, Switzerland--

Signed and Sealed this

Twenty-second Day of February 1977

[SEAL]

*Attest:*

RUTH C. MASON
*Attesting Officer*

C. MARSHALL DANN
*Commissioner of Patents and Trademarks*